US007666129B2

(12) United States Patent
Lyga et al.

(10) Patent No.: US 7,666,129 B2
(45) Date of Patent: Feb. 23, 2010

(54) PAPER FOLDER UTILIZING SHEET INVERSION TO DEVELOP AUXILIARY FOLD TYPES

(75) Inventors: Thomas M. Lyga, Southbury, CT (US); James A. Fairweather, Milford, CT (US); David J. Eaton, Newtown, CT (US); Carl R. Chapman, Monroe, CT (US)

(73) Assignee: Pitney Bowes Inc., Stamford, CT (US)

( * ) Notice: Subject to any disclaimer, the term of this patent is extended or adjusted under 35 U.S.C. 154(b) by 32 days.

(21) Appl. No.: 11/786,936

(22) Filed: Apr. 13, 2007

(65) Prior Publication Data

US 2007/0265153 A1 Nov. 15, 2007

Related U.S. Application Data

(60) Provisional application No. 60/795,797, filed on Apr. 28, 2006.

(51) Int. Cl.
*B31F 7/00* (2006.01)

(52) U.S. Cl. ..... 493/420; 493/419; 493/429

(58) Field of Classification Search ..... 493/420, 493/419, 421, 405, 424, 429
See application file for complete search history.

(56) References Cited

U.S. PATENT DOCUMENTS

| | | | | | |
|---|---|---|---|---|---|
| 4,586,704 | A * | 5/1986 | Lehmann et al. | ..... | 270/46 |
| 4,603,971 | A * | 8/1986 | Kukucka et al. | ..... | 355/133 |
| 4,717,134 | A * | 1/1988 | Iida et al. | ..... | 270/39.01 |
| 4,900,391 | A * | 2/1990 | Mandel et al. | ..... | 156/364 |
| 4,924,652 | A * | 5/1990 | Krasuski et al. | ..... | 53/55 |
| 5,007,625 | A * | 4/1991 | Kremers et al. | ..... | 270/58.01 |
| 5,080,340 | A * | 1/1992 | Hacknauer et al. | ..... | 270/37 |
| 5,364,332 | A * | 11/1994 | Gray, Jr. | ..... | 493/23 |
| 5,520,603 | A * | 5/1996 | Bluthardt et al. | ..... | 493/421 |
| 6,016,638 | A * | 1/2000 | Bernard et al. | ..... | 53/117 |
| 6,206,816 | B1 * | 3/2001 | Cook et al. | ..... | 493/420 |
| 6,226,959 | B1 * | 5/2001 | Krasuski et al. | ..... | 53/117 |
| 6,453,647 | B1 * | 9/2002 | Adams et al. | ..... | 53/460 |

* cited by examiner

*Primary Examiner*—Sameh H. Tawfik
(74) *Attorney, Agent, or Firm*—Ronald Reichman; Angelo N. Chaclas

(57) ABSTRACT

A method and apparatus for folding inserts by inverting the insert sheet after the first fold is made and reintroducing the folded insert sheet into a first buckle chute from the opposite end. The second fold is then made in a second buckle chute which results in either a bottom address or a middle address appearing on the folded insert in a manner that the address will appear through the window of the envelope.

8 Claims, 8 Drawing Sheets

PAPER FOLDER UTILIZING SHEET INVERSION TO DEVELOP AUXILIARY FOLD TYPES

This Application claims the benefit of the filing date of U.S. Provisional Application No. 60/795,797 filed Apr. 28, 2006, which is owned by the assignee of the present Application.

FIELD OF THE INVENTION

The invention relates generally to sheet folding and inserting machines and more particularly to a method for folding and transporting paper such that a specific region of the paper can be positioned in the window of a receiving envelope.

BACKGROUND OF THE INVENTION

Sheet folding machines have long been well known and have enjoyed great commercial success in a variety of document processing applications, particularly those associated with the preparation of mail in which one or a plurality of sheets are folded in a variety of configurations before being inserted into envelopes in an envelope inserting machine. Briefly, folding machines of this character comprise one or a pair of buckle chutes and a plurality of sets of feeding and folding rollers. In a typical arrangement, sheets are fed into the folding mechanism and directed into a first buckle chute by a first pair of feeding rollers until the lead edge of the sheet strikes a stop, after which the portion of the sheet adjacent to the entrance of the buckle chute buckles to form a new lead edge, which then passes through the next pair of feeding rollers which creases the new lead edge, thereby forming a first fold in the sheet. The new lead edge is then directed into a second buckle chute until it strikes a stop, which causes the portion of the sheet adjacent to the entrance of the second buckle chute to buckle and form still another new lead edge, and this new lead edge then passes through still another pair of feeding rollers which again creases the lead edge, thereby forming a second fold in the sheet. The tri-folded sheet is then fed through a discharge path from the folding machine.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

Often times the address of the recipient appears on the folded insert, which is then inserted into a windowed envelope. Sometimes the recipient's address appears on the top ⅓ panel of the document. In these cases the conventional two buckle chute folder may be configured to fold the document in a "C" or "Z" fold so that the recipient's address will appear through the window of the envelope. The above fold types accommodate the customer needs of certain users. The recipient's address may also appear on different portions of the folded insert, for instance, the bottom portion or middle portion of the folded insert. Bottom addressing and middle addressing of inserts normally require folders with opposite buckle chute arrangements, positioned both above and below the folder paper path. Such arrangements normally results in a folder with a minimum of three buckle chutes to accomplish all the basic fold types, i.e., top address C-fold, and the auxiliary fold types, middle address C fold and bottom address Z fold.

A disadvantage of the prior art is that three buckle chutes are required to perform the basic fold types for bottom and middle addressing of inserts. Another disadvantage of the prior art is that one of the three buckle chutes must be positioned to oppose the other two buckle chutes, making it difficult to transport material past the folder either above or below without folding the material or intersecting the mechanical assembly of the buckle chute.

SUMMARY OF THE INVENTION

This invention incorporates a folder into an insertion system that overcomes the disadvantages of the prior art by inverting the insert sheet after the first fold is made and reintroducing the folded insert sheet into the first buckle chute from the opposite end. The second fold is then made in the second buckle chute which results in either a bottom address or a middle address appearing on the folded insert in a manner that the address will appear through the window of the envelope.

An advantage of the foregoing is that all of the basic fold types may be accomplished in an insertion system without the need to incorporate an opposing buckle chute. Thus, the space on one side of the folder paper path may be used for other mail processing functions. The capability to perform specific fold functions may also be decoupled from the basic folder which enables greater flexibility in the build and sale of the folder system.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PRESENT INVENTION

Figure 1:
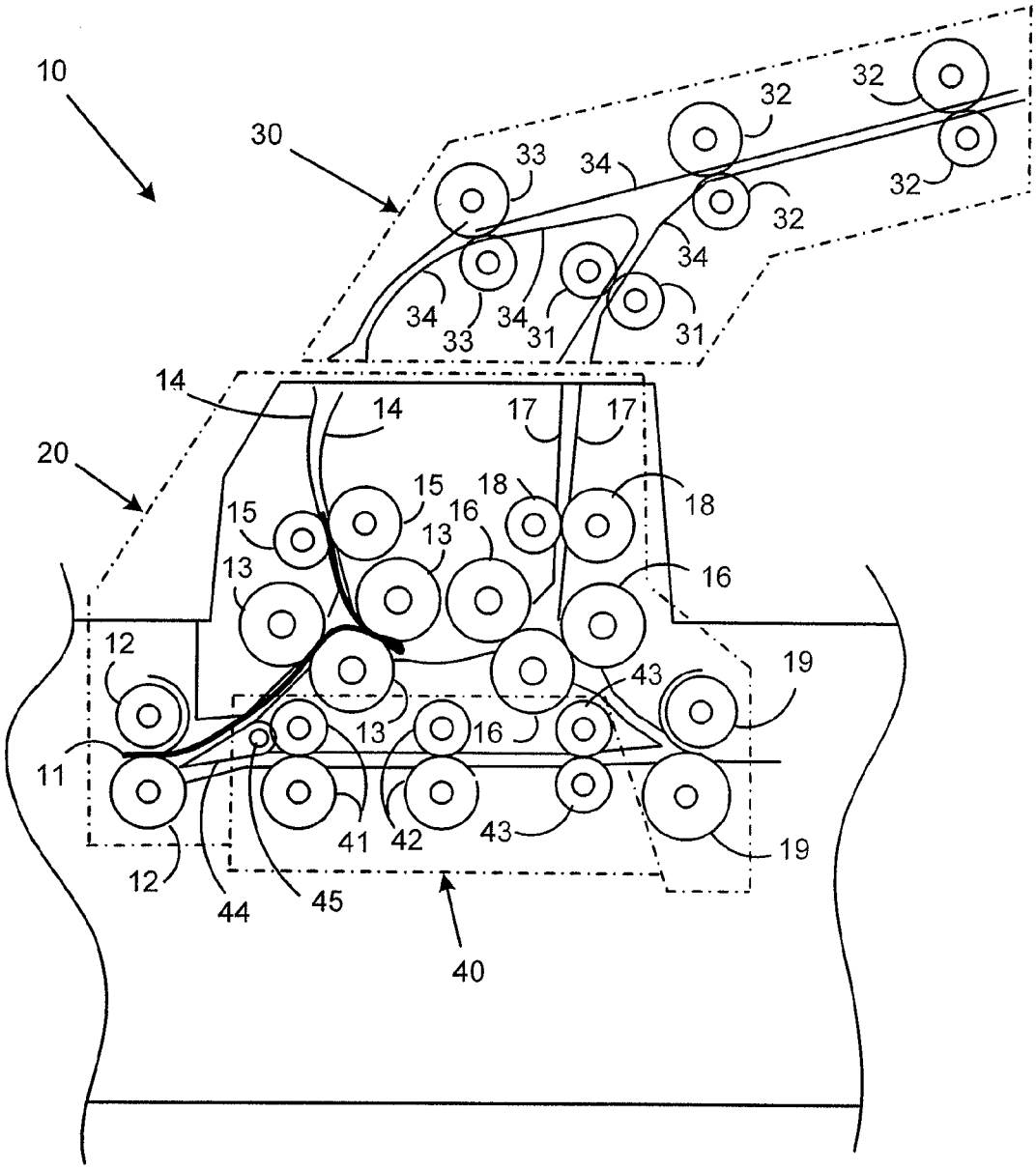
FIGS. 1-7 are drawings of a folder paper path with sheet inversion showing, the progression or a single sheet to accomplish a z-fold.

In describing the present invention, reference is made to the drawings, wherein similar reference numerals in FIGS. 1-7 designate similar elements in the various views.

Referring now to the drawings in detail and more particularly to FIG. 1 the folder system 10 is shown with document 11 entering folder 20 through transport nip 12 and undergoing fold formation in the first fold roller cluster 13. Document 11 enters folder 20 with the printed face of document 11 facing down and the recipients address at the leading edge of document 11. The document 11 is advanced into the first buckle chute 14 by a distance equal to ⅓ of the length of document 11 prior to the formation of the first fold of document 11. The foregoing describes the process of forming the first fold of document 11.

Folder 20 includes roller cluster 13, buckle chute 14, smart nip 15, roller cluster 16, buckle chute 17, smart nip 18 and folder exit nip 19. Document inverter 30 comprises: a secondary path i.e. inverter entry nip 31; inversion nips 32; exit nip 33 and paper guides 34. Folder bypass path 40 includes transport nips 41, 42 and 43.

Document 11 upon entering folder entrance nip 12 may be selectively transported to folder 20 (a primary folder path) or folder bypass path 40 through the articulation of the entrance gate 44. It should be obvious to one skilled in the art that entrance gate 44 may be pivoted axis 45, such that document 11 would be transported to the folder bypass path 40 which would prevent the formation of folds in document 11. Thus, folding system 10 provides the option to not fold document 11.

Figure 5:
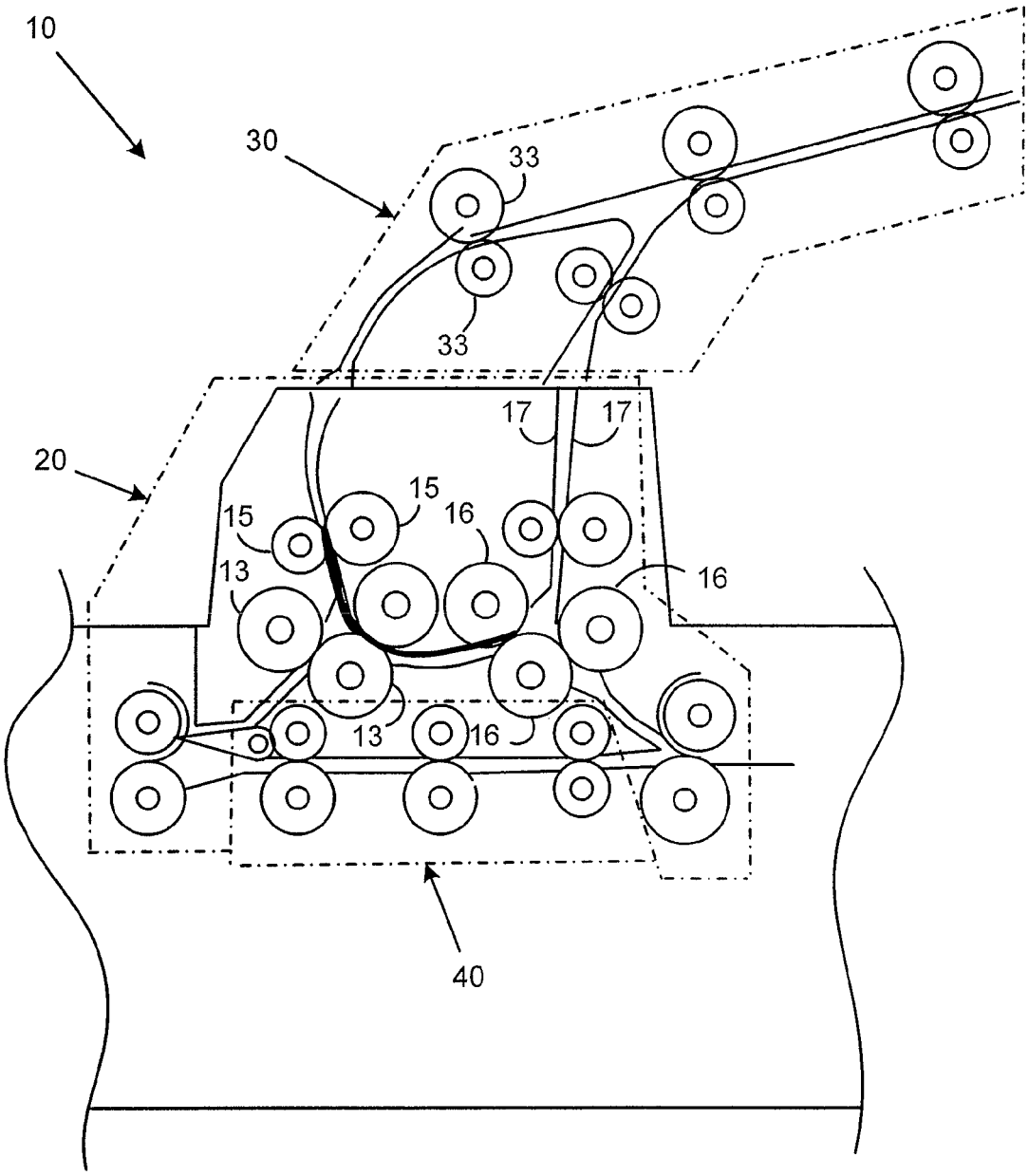
Figure 6:
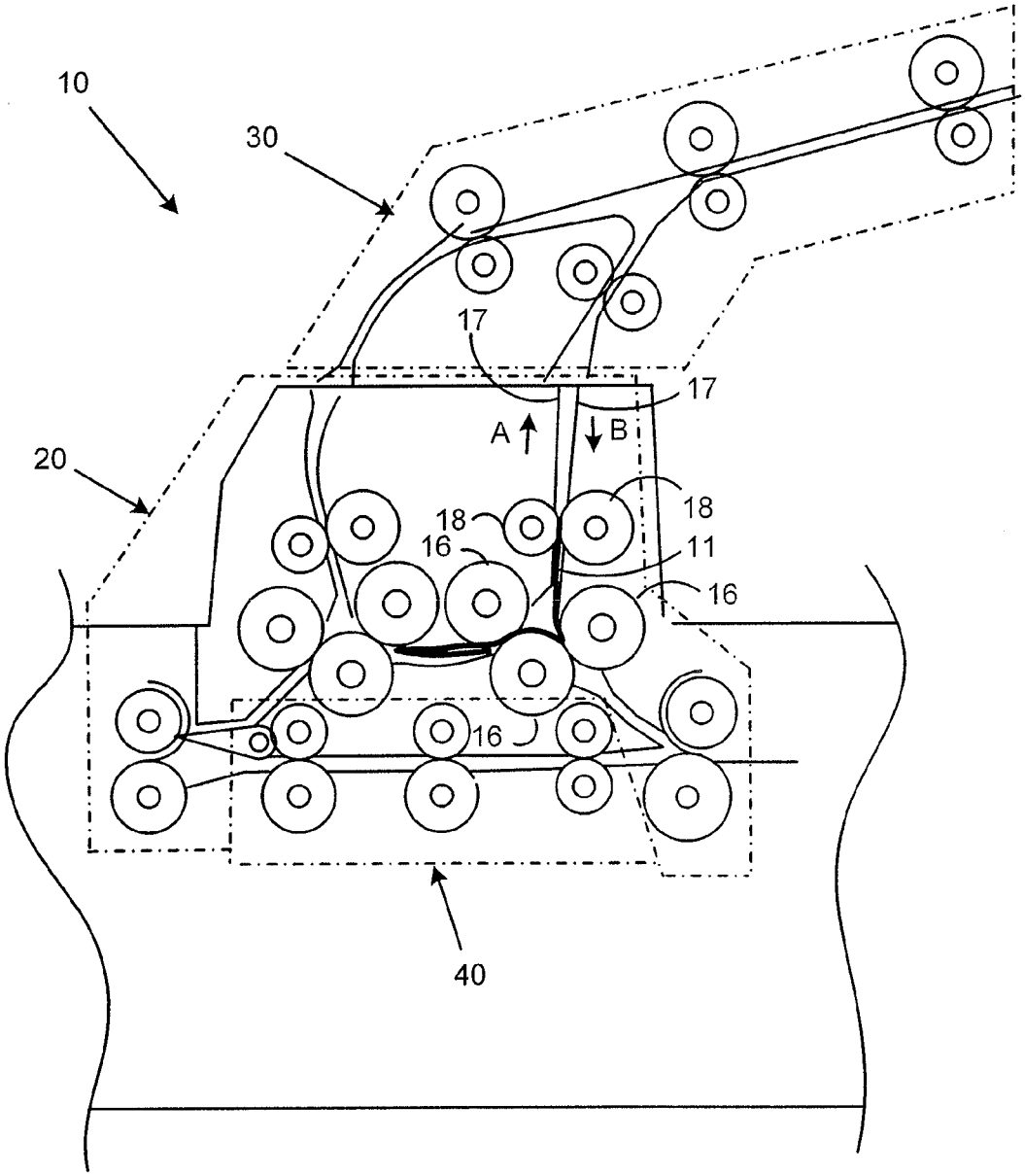
Figure 7:
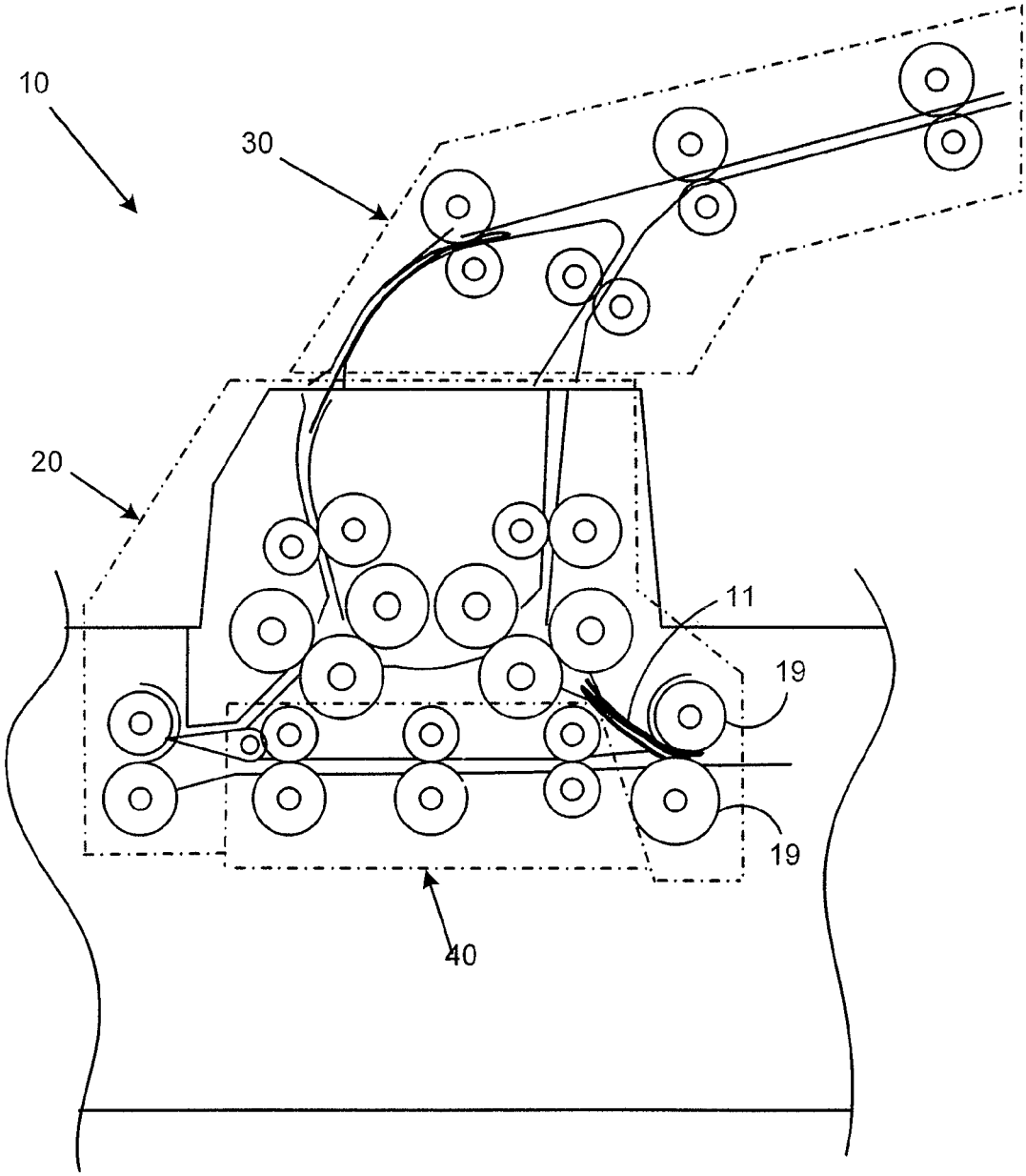

FIGS. 2-7 illustrate the progression of the document through the fold system paper path with FIG. 7 showing a fully formed bottom address z-fold exiting the folder.

Also shown in each Fig. is a paper path that by-passes the fold system. The foregoing paper path system can not readily be realized in a system having opposing buckle chutes.

Figure 2:
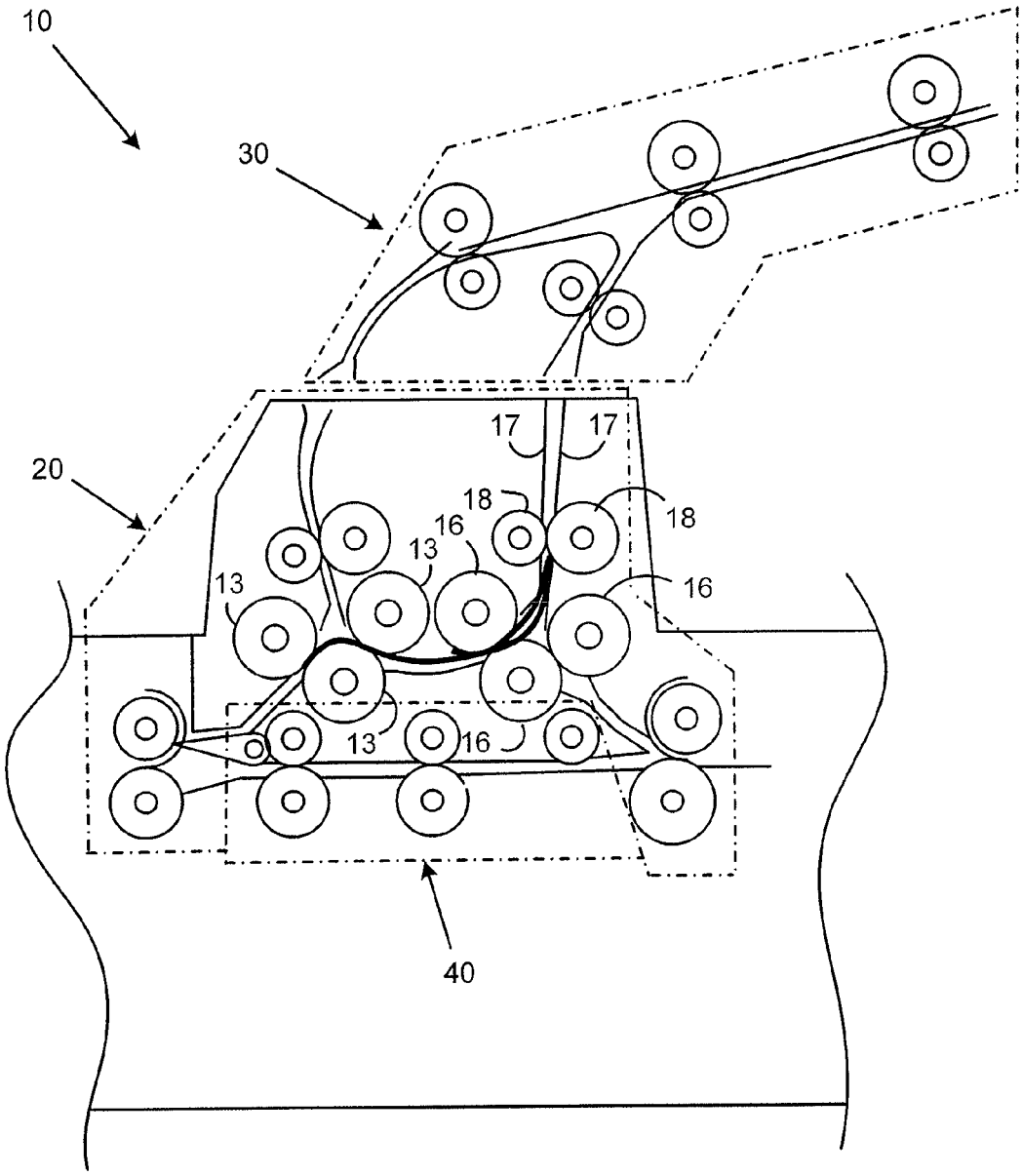

FIG. 2 illustrates the second step in the formation of a bottom address Z fold. Document 11 has advanced from first fold roller cluster 13 to fold cluster 16 and the leading edge of document 11 has entered buckle chute 17 and is approaching smart nip 18.

Figure 3:
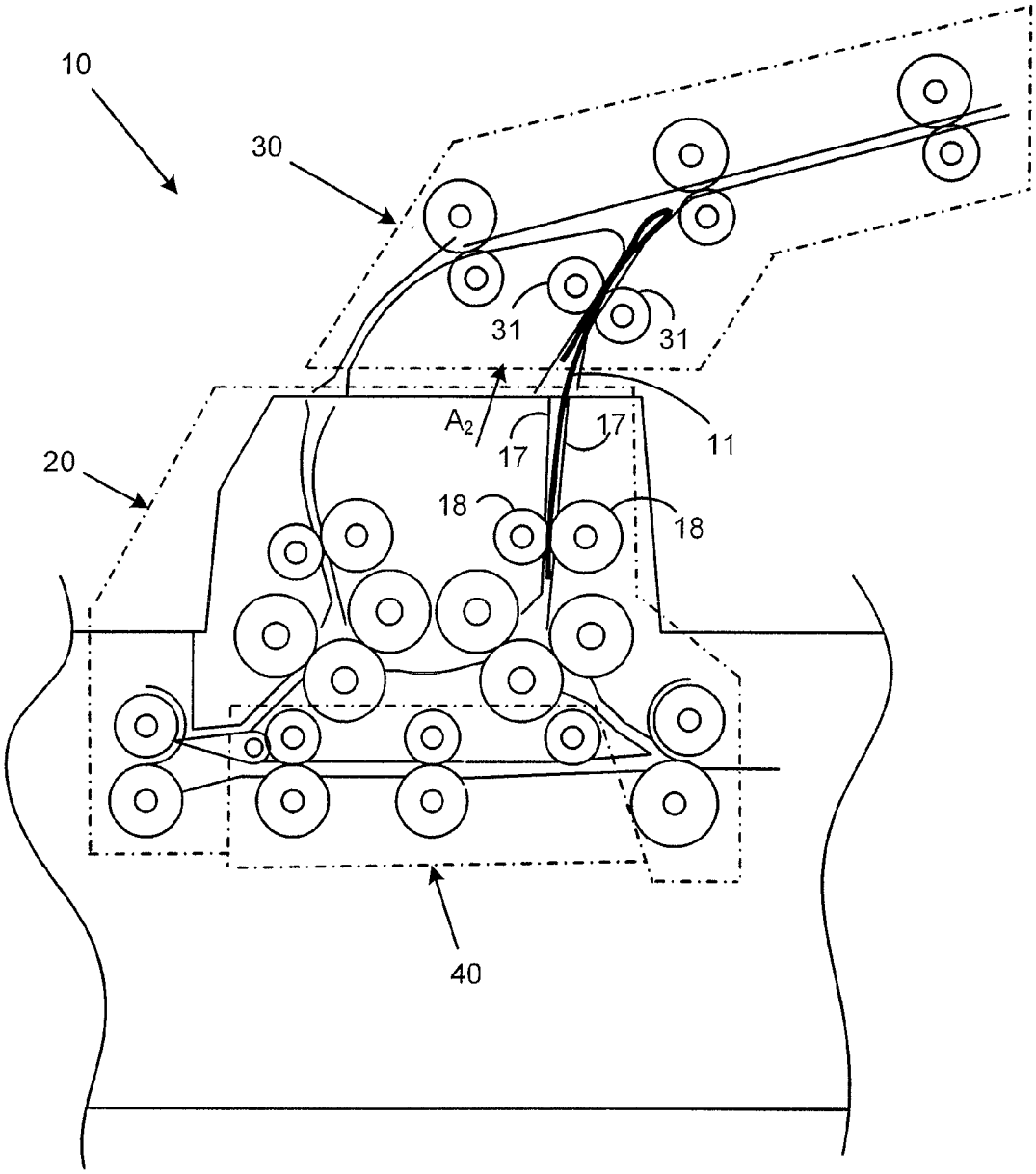

FIG. 3 illustrates the third step in the formation of a bottom address Z fold. Document 11 has been driven by smart nip 18 in a direction "A" through buckle chute 17 and has entered inverter entry nip 31.

Figure 4:
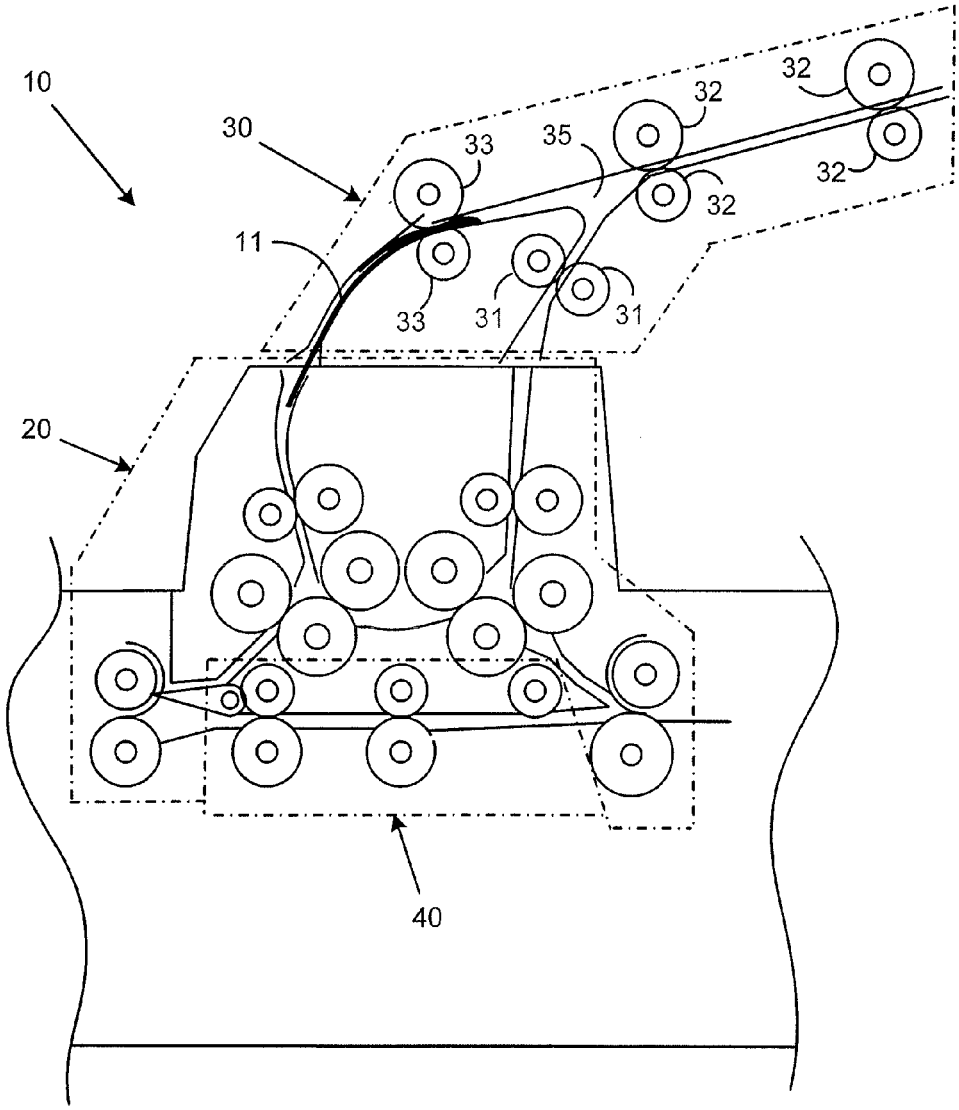

FIG. 4 illustrates the fourth step in the formation of a bottom address Z fold. Document 11 has been transported by entry nip 31 to inversion nips 32 which upon receiving document 11 and driving the trailing edge of document 11 past the inversion point 35 have then reversed the direction of travel of document 11 and have transported document 11 to inverter exit nip 33. The path from nip 31 to nips 32 and 33 is a second inversion path. Note that the current leading of document 11 was the trailing edge of document 11 as shown in FIGS. 1-3.

FIG. 5 illustrates the fifth step in the formation of a bottom address Z fold. Document 11 has been driven by inverter exit nip 33 to smart nip 15 which has received document 11 and transported document 11 to first fold roller cluster 13. Document 11 is shown spanning smart nip 15, first fold roller cluster 13, and fold cluster 16 with the unfolded edge of documents 1 advancing towards buckle chute 17.

FIG. 6 illustrates the sixth step in the formation of a bottom address Z fold. Document 11 is shown during the process of the second fold formation in fold cluster 16. Smart nip 18 has received the unfolded edge of document 11 and transported document 11 in direction "A" until document 11 has entered buckle chute 17 by the length desired for the second fold. Smart nip 18 has then reversed the direction of document 11, driving document 11 in direction "B" towards fold cluster 16 which forms the second fold of document 11.

FIG. 7 illustrates the fully formed bottom address Z fold of document 11 exiting the folder 20 via folder exit nip 19.

Figure 8:
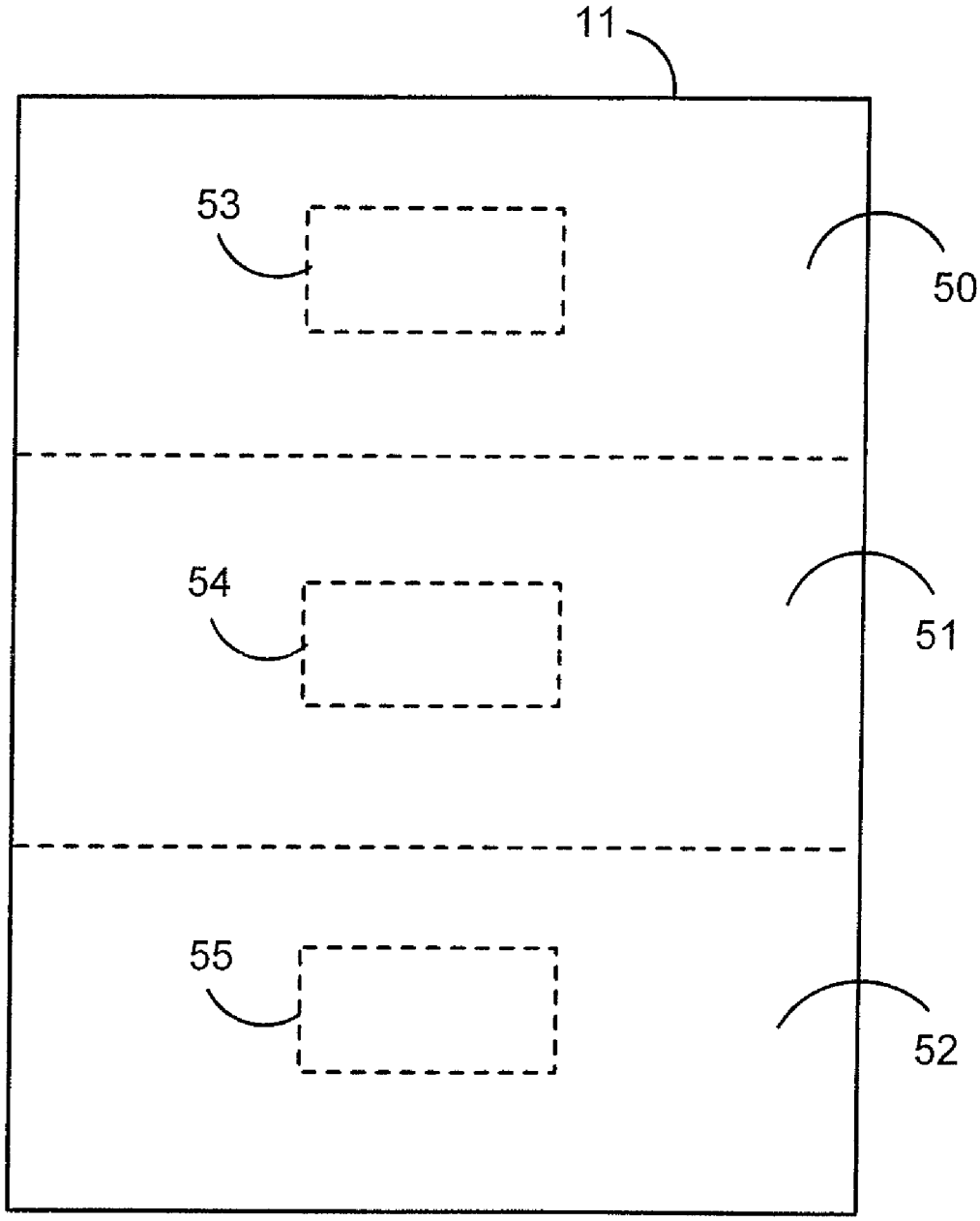
FIG. 8 is a drawing of document 11 showing three fold panels and three possible address locations.

FIG. 8 is a drawing of document 11 showing three fold panels and three possible address locations. Document 11 has panels 50, 51 and 52. Panels 50, 51 and 52 are respectively ⅓ the length of document 11. It would be obvious to one skilled in the art that the operator of folder 20 may select specific length for panels 50, 51 and 52 and these lengths may be produced by folder 20 by control of the motion of smart nips 15 and 18. The address of the recipient of document 11 may be placed on any of the panels 50, 51 and 52 and the choice of placement is at the discretion of the operator of folder system 10. Thus, it is desirable to have a folder system that is capable of transforming document 11 into a folded document when the address is located in spaces 53, 54 or 55. Thereby, allowing the insertion of document 11 into an envelope with the correct orientation and the exposure of the recipient address in a window envelope.

The advancing of the document into the first buckle chute by a distance equal to ⅔ of the length of the document and executing the paper path processes described in FIGS. 2-7 will result in the formation of a middle address C fold.

Two documents may be processed in the paper paths described in FIGS. 2-7 such that the document is introduced to the paper path as the first document is advanced to the document inverter 30. Through careful selection of the paper path length and the timing of the introduction of subsequent documents it is possible to maintain sustained processing and increase the through put of the documents in the paper path.

The above specification describes a new and improved method for method for folding and transporting paper such that a specific region of the paper can be positioned in the window of a receiving envelope. It is realized that the above description may indicate to those skilled in the art additional ways in which the principles of this invention may be used without departing from the spirit. Therefore, it is intended that this invention be limited only by the scope of the appended claims.

What is claimed is:

1. A method for creating different document fold types, the method comprising the steps of;

using a primary folding path to form one or more sequential folds on the document or using the primary folding path to form a first fold of the document and inverting the document in a secondary path and forming a second fold on the document in the primary folding path, whereby, fold geometry and document address orientation on the document are different when folds are created in the primary folding path and where folds are created in the primary folding path and the secondary path, so that a Z fold and a C fold formed in the primary folding path accommodates a different address orientation than a z fold and a c fold formed in the primary folding path and the secondary folding path.

2. The method claimed in claim 1, wherein top address C folds, top address Z folds and top address double folds are produced in the primary folding path.

3. The method claimed in claim 1, wherein bottom address Z folds, middle address C folds and third panel double folds are produced in the primary folding path and in the secondary path.

4. The method claimed in claim 1, wherein the document contains an address that will appear in a window of a envelope when the document is inserted into the envelope.

5. The method claimed in claim 1, further including the step of:

introducing a second document into the primary folding path when the first document is in the secondary path to increase the through put.

6. The method claimed in claim 1, further including the step of:

forming a by pass path to process unfolded documents.

7. The method claimed in claim 1, wherein the primary folding path has a first full length and a second full length that specify the geometry of the fold that is produced.

8. The method claimed in claim 1, wherein the primary folding path has a first full length and the secondary path has a first full length that specify the geometry of the fold that is produced.

* * * * *